US005673800A

United States Patent [19]

Connolly

[11] Patent Number: 5,673,800

[45] Date of Patent: Oct. 7, 1997

[54] WALL HANGING PLATE HOLDING APPARATUS

[75] Inventor: Robert Connolly, White Lake, Mich.

[73] Assignee: Huron Valley Design, White Lake, Mich.

[21] Appl. No.: 515,458

[22] Filed: Aug. 15, 1995

[51] Int. Cl.[6] ..... A47G 19/08

[52] U.S. Cl. ..... 211/41; 211/87

[58] Field of Search ..... 211/41, 87, 88, 211/89; 248/74.2, 71

[56] References Cited

U.S. PATENT DOCUMENTS

| | | | |
|---|---|---|---|
| D. 115,615 | 7/1939 | Farrah . | |
| D. 266,461 | 10/1982 | Helzer | D6/142 |
| D. 337,466 | 7/1993 | Moser | D6/570 |
| 674,868 | 5/1901 | Lane . | |
| 878,315 | 2/1908 | Samsó . | |
| 2,265,701 | 12/1941 | Richards | 248/30 |
| 2,488,147 | 11/1949 | Thiesen | 248/30 |
| 2,633,994 | 4/1953 | Brown | 211/41 |
| 2,835,394 | 5/1958 | Seymour | 211/41 |
| 2,899,154 | 11/1959 | Zavolner | 248/30 |
| 4,457,484 | 7/1984 | Hameister | 248/490 |
| 4,561,617 | 12/1985 | Hafner | 248/121 |
| 5,145,074 | 9/1992 | Miley | 211/41 |
| 5,277,387 | 1/1994 | Lewis | 248/74.2 |

*Primary Examiner*—Ramon O. Ramirez
*Assistant Examiner*—Gwendolyn W. Baxter
*Attorney, Agent, or Firm*—Brooks & Kushman P.C.

[57] ABSTRACT

The present invention provides an apparatus for display and support of one or more plates. The apparatus comprises two sets of support members which are arranged in two tiers to hold three plates. Each plate is supported at spaced points about its outer periphery. The upper support is connected to two pivotable arms to support one plate about its outer periphery to prevent horizontal and vertical movement of said plate. The lower support has two pivotable arms to support two plates about their outer peripheries to prevent horizontal and vertical movement of the two plates. The lower support also has rear supports which prevent a plate's backward movement. The upper and lower supports are interconnected by a bracket which is securable to a wall. A portion of the upper support engages the upper, outer periphery of the two plates in the lower tier of plates to prevent forward movement.

15 Claims, 1 Drawing Sheet

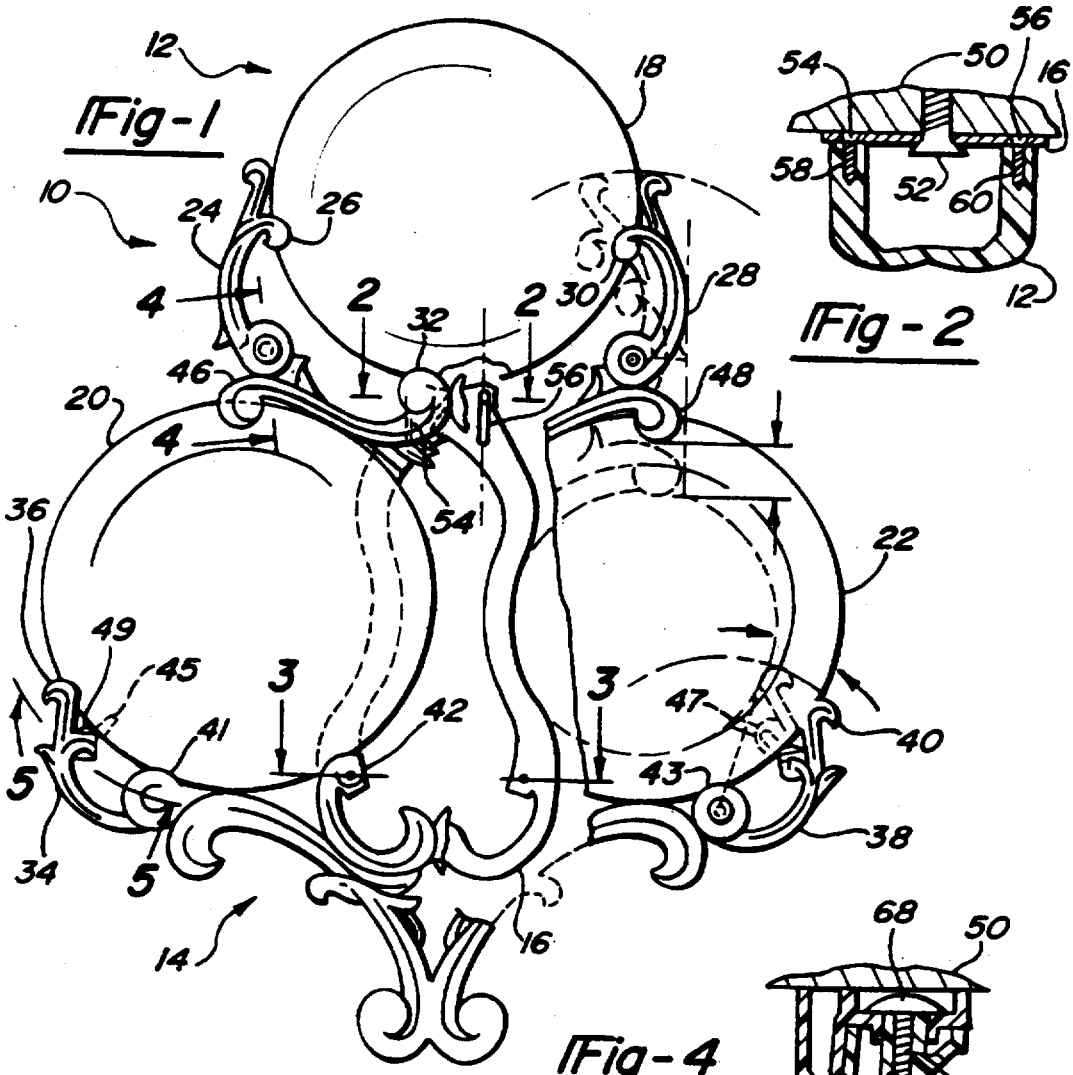
Fig-1
Fig-2
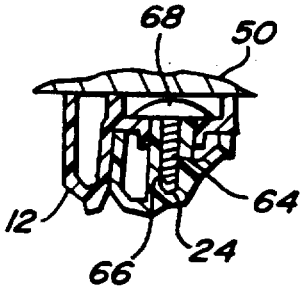
Fig-4
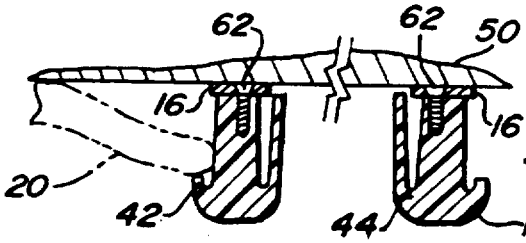
Fig-3
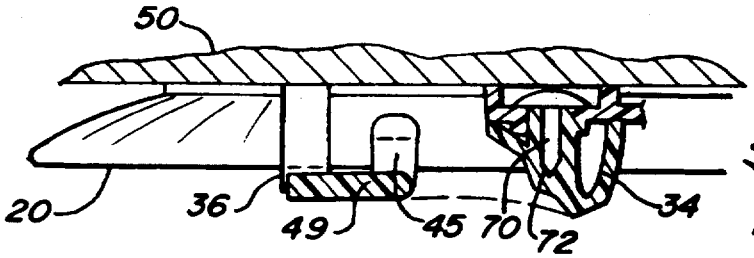
Fig-5

WALL HANGING PLATE HOLDING APPARATUS

TECHNICAL FIELD

This invention relates to an apparatus for decorative display of plates and the like and, more particularly, to a plate holder for two-tiered wall display of plates which may be of different sizes.

BACKGROUND ART

Plates are commonly used for decorative display and are popular collector's items. However, the prior art reveals difficulties in attractively displaying multiple plates, plate sets, or plates of different sizes, which may be desired by avid collectors.

For example, U.S. Pat. No. 2,265,701 to Richards discloses a plate hanger with spring biased hooks which cooperate with two support hooks. Two springs expand and contract in a generally vertical plane to allow the spring biased hook of the apparatus to adjust to plates of various sizes. The disadvantage of this plate holder is that it can hold only one plate and it is inflexible, unattractive, and cumbersome.

Another prior art device is U.S. Pat. No. 2,488,147 to Theisen which discloses a plate holder and table lamp which accommodates a maximum of three plates of the same size. The support members of the apparatus consist of three sets of springs with hook-link ends which are looped around a vertical rod in the lamp's base. A disadvantage of this plate holder is that at least one plate is always obscured from view at a given time. Further, the lamp base device is complicated and inflexible.

U.S. Pat. No. 4,457,484 to Hameister discloses a single-plate holder with clips which engage the plate's outer periphery. The holder's clips are each slidable in an elongated slot to accommodate plates of various heights. A disadvantage of this plate holder is its unattractiveness and the lack of security provided by the clips.

Lastly, U.S. Pat. No. 674,868 to Lane, U.S. Pat. No. 2,835,394 to Seymour, and U.S. Pat. No. 5,145,074 to Miley disclose plate holders with multiple tiers or rows which accommodate several plates. However, each plate holder's configuration results in an obstructed view of at least one of its plates. These obstructions are caused by wooden support strips or other plates held by the display. One disadvantage of these plate holders is their inability to provide a full frontal view of each plate on display.

SUMMARY OF THE INVENTION

The prior art reveals no plate holder which is a multi-tiered apparatus having support members that are pivotable and slidably adjust to display a plurality of plates of various sizes without unsightly obstructions. The present invention provides these advantages.

It is an object of the present invention to provide an improved plate holder apparatus comprising two tier support, each having pivotable members for retaining one or more plates in each tier, and also comprising a slide to complete the support for plates in the lower tier.

It is another object of the present invention to provide a plate holder apparatus of the type described above which provides an unobstructed, frontal view of all plates at once and is flexible, attractive, easy to mount and dismount, and adjustable to accommodate a plurality of plates of different sizes.

Yet another object of the present invention is to provide a plate holder apparatus of the type described above which comprises support members that are pivotable and slidably adjustable to peripherally support a plurality of plates.

According to one embodiment of the invention, a single plate holding apparatus is provided wherein a support member is secured to a wall which includes a plate engaging element for engaging a lower portion of the plate to prevent movement of the plate away from the wall. A first pivotable holder is secured to the support member and has a plate engaging element for contacting a peripheral portion of the plate at a location spaced from the point at which the support member contacts the lower portion of the plate. The plate engaging element prevents movement of the plate away from the wall and parallel to the wall in one lateral direction. A second pivotable holder may also be secured to the support member and has a plate engaging element for contacting a peripheral portion of the plate at a location spaced from the lower portion of the plate for preventing movement of the plate away from the wall and parallel to the wall in the opposite lateral direction.

The support member and first and second pivotable holders are decorative members preferably formed of wood or of plastic material having a carved wood appearance.

The first and second pivotable holders are secured to the support member by fasteners which lock the pivotable holders to the support member at a selected pivotable orientation.

According to another object of the invention, a multi-tiered wall hanging apparatus is provided for holding an upper tier plate and two lower tier plates on a wall.

The multi-tiered wall hanging apparatus comprises an upper support member which is secured to the wall. The upper support member has a first upper tier plate engaging element contacting a lower portion of the upper tier plate for supporting and preventing movement of the upper tier plate away from the wall. First and second upper pivotable holders have second and third upper tier plate engaging elements which contact a peripheral portion of the upper tier plate at a location spaced from the point at which the first upper tier plate engaging element contacts the upper tier plate. The first and second upper pivotable holders prevent the plate from moving away from the wall and also prevent the plate from moving in either lateral direction parallel to the wall. The wall hanging apparatus also includes a lower support member secured to a wall. The lower support member has first and second lower tier plate engaging elements, each contacting a lower portion of one of the two lower tier plates, which prevent movement away from the wall of the lower tier plates. First and second lower pivotable holders have third and fourth plate engaging elements and base supports and are adapted to contact peripheral portions of one of the lower tier plates at a location spaced from the first and second lower tier plate engaging elements of the 10 lower support member. A lower rear support prong grips the underside of each plate's periphery at a location spaced between the lower tier plate engaging elements and the lower pivotable holders. The first and second lower pivotable holders and the lower rear support prong prevent the lower tier plates from moving toward or away from the wall and also from moving laterally in a direction parallel to the wall.

According to another object of the multi-tiered wall hanging plate holder apparatus, a bracket may be provided to interconnect the upper support member and the lower support member. The bracket may be used to secure the upper and lower support members to the wall. The bracket also permits the upper and lower support members to be secured to the bracket within a range of relative spacing to each other to accommodate a range of different sizes of plates on the lower tier. The bracket preferably includes at least one slot which extends either directly vertical or at an angle including a vertical component. A fastener is received in the slot to secure the upper support member to the bracket. The upper support member preferably includes first and second lower tier plate engaging elements for securing the lower tier plates in conjunction with the plate engaging element of the lower support member and the first and second lower pivotable holders.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 1 is a front elevational view of a plate holder providing two-tiered wall display of plates and the like;

FIG. 2 is a partial cross-sectional view taken along line 2—2 of FIG. 1 showing a mount for slidable adjustment and a center mount of a plate holder bracket;

FIG. 3 is a partial cross-sectional view taken along line 3—3 of FIG. 1 showing two laterally spaced support members which support a plate against horizontal movement;

FIG. 4 is a partial cross-sectional view taken along line 4—4 of FIG. 1 showing a pivot of a first tier support member; and FIG. 5 is a partial cross-sectional view taken along arc of FIG. 1 showing back support, side support, and base support for a plate in the second tier from a second tier pivotable support member.

BEST MODES FOR CARRYING OUT THE INVENTION

Referring now to FIG. 1, a wall hanging plate holding apparatus 10 made in accordance with the present invention is shown. The plate holding apparatus 10 includes an upper support member 12 which may be used as a wall hanging plate holder for a single plate. In the multi-tiered embodiment a lower support member 14 is provided and is connected to the upper support member 12 by a bracket 16. Although not preferred, the bracket 16 could be omitted and upper and lower support members 12 and 14 could be directly mounted on a wall. As shown in FIG. 1, an upper tier plate 18 and left and right lower tier plates 20 and 22 are shown as they are retained in the plate holding apparatus 10.

An upper left pivotable holder 24 has a plate engaging element 26 which is adapted to engage the rim or periphery of the upper tier plate 18. Upper right pivotable holder 28 includes a plate engaging element 30 for holding the rim or periphery of the upper tier plate 18 at an opposite lateral position from the left pivotable holder. The upper support member 12 includes a plate engaging element or elements 32. The plate engaging elements 26, 30 and 32 cooperate to hold the upper tier plate 18 in place on the upper support member 12 and prevent the upper tier plate 18 from moving away from the wall 50 or moving laterally in either direction parallel to the wall 50. Right and left pivotable holders 24 and 28 are secured to the upper support member 12 in a pivotable manner to accommodate a variety of plate sizes as will be described more fully below. Since decorative plates come in a wide range of sizes, typically from 6 inches in diameter to 12 inches in diameter, the pivotable holders 24 and 28 provide an effective locating system for the upper tier plate 18.

Left and right lower tier plates 20 and 22 are retained on the lower support member 14 in conjunction with a lower left pivotable holder 34 which includes a plate engaging element 36 and base support 41 and a lower right pivotable holder 38 which includes a plate engaging element 40 and base support 43. Lower support member 14 includes first and second plate engaging elements 42 and 44 which are adapted to engage left and right lower tier plates 20 and 22, respectively. Lower support member 14 also includes left and right rear support prongs 45 and 47 which engage the underside of left and right lower tier plates 20 and 22, respectively. Rear support prongs 45 and 47 hold plates 20 and 22 in the lower tier even if the apparatus is not secured to a wall.

Left lower tier plate 20 is retained on the lower support member 14 by the cooperation of the lower support member 14, the lower left pivotable holder 34 and its base support 41, the lower left plate engaging elements 42 and 36, and the left rear support prong 45. A first lower tier plate engaging element 46 is preferably provided on the upper support member 12 which also engages the upper rim of the left lower tier plate 20. Second lower tier plate engaging element 48 on the upper support member 12 engages the upper portion of the right lower tier plate 22 and operates in conjunction with the second plate engaging element 44 on the lower support member 14, the plate engaging element 40 and base support 43 of the lower right pivotable holder 38, and the right rear support prong 47.

Referring now to FIGS. 1 and 2, upper and lower support members 12 and 14 are connected to the bracket 16 which is in turn secured to the wall 50 by means of a fastener 52.

Bracket 16 preferably includes first and second slots 54 and 56 which each receive fasteners 58 and 60 to secure the bracket 16 to the upper support member as shown in FIG. 2. Fasteners 58 and 60 may be used to secure the upper support member 12 to the bracket 16 within a range of locations to allow for adjustment of the relative location of the upper and lower support members 12 and 14 and thereby allow for adjustment of the first and second plate engaging elements 32 on the upper support member 12. The adjustability of the upper support member 12 relative to the lower support member 14 on the bracket 16 is best shown in FIG. 1.

Referring now to FIG. 3, fasteners 62 are used to secure the bracket 16 to the lower support member 14 at two locations. First and second plate engaging elements 42 and 44 on the lower support member 14 are also shown in FIG. 3.

Referring now to FIG. 4, the interconnection of the upper support member 12 and the upper left pivotable holder 24 is shown. The connection of the upper support member 12 to the upper right pivotable holder 28 is essentially the same and, for brevity, will not be repeated. A pivot fastener 64 is received in a bore 66 which is preferably threaded (or is unthreaded and receives a self-tapping fastener) with the head 68 of the pivot fastener 64 seating against the upper support member 12 and the pivot fastener 64 being received in the bore 66 formed in the upper left pivotable holder 24.

Referring now to FIG. 5, the support from the lower left pivotable holder 34 of the lower support member 14 for a lower left plate 20 is shown. The support from the lower right pivotable holder 38 of the lower support member 14 for a lower right plate 22 is similar and, for brevity, will not be repeated. The support from the pivotable holder 34 of the lower support member 14 consists of a base support 41 upon which a portion of the bottom periphery of the lower tier plate 20 is mounted to prevent vertical movement. The base support of the pivotable holder 34 of the lower support member 14 is adjacent to and pivotable with respect to the decorative bottom portion of the lower support member 14 which is secured to the bracket 16. Side support for the plate 20 from the pivotable holder 34 of the lower support member 14 is achieved by a plate engaging element 36 which engages a portion of the lower side periphery of the plate 20. Rear support for the plate 20 from the pivotable holder 34 of the lower support member 14 is achieved by a rear support prong 45. The rear support prong 45 is connected to a mount 49 located on the backside of the pivotable holder 34 and extends inwardly to grip a lower backside portion of the plate 20. The interconnection of the engaging element 36 and the rear support prong 45 of the pivotable holder 34 creates a space wherein the plate 20 is located and prevented from forward, backward, or lateral movement.

When installing the apparatus 10 two lower tier plates 20, 22 can be locked on the lower support member 14 by the upper support member 12 and rear support prong 45 holding the plates in place. The bracket 16 is then hung on the wall 50 with the upper tier plate 18 being placed on the upper support member 12.

It should be understood that the above embodiments of the present invention are described to provide an enabling disclosure of the best mode of practicing applicant's invention and is to be read as being illustrative of applicant's invention but not in a limiting sense. The broad scope of applicant's invention should be interpreted in view of the following claims.

What is claimed is:

1. A wall hanging apparatus and a plate, the combination comprising:

a support member adapted to be secured to a wall, said support member having a plate engaging element contact a lower portion of the plate for supporting and preventing movement away from the wall of the lower portion of the plate;

a first holder movably secured to the support member having a plate engaging element contacting a peripheral portion of the plate spaced from said lower portion for preventing movement of the plate way from the wall and parrallel to the wall in one lateral direction;

a second holder movably secured to the support member having a plate engaging element contacting another peripheral portion of the plate spaced from said lower portion of plate for preventing movement of the plate away from the wall and parallel to the wall in the opposite lateral direction from said one lateral direction; and said support member is secured to said first and second holders by fasteners which lock each of the holders to the support member at a selected pivotal orientation.

2. A multi-tiered wall hanging apparatus secured to a wall for holding an upper tier plate and two lower tier plates on the wall comprising:

an upper support member having a first upper tier plate engaging element contacting a lower portion of the upper tier plate for supporting and for preventing movement away from the wall of the lower portion of the upper tier plate;

a first upper pivotable holder secured to the upper support member having a second upper tier plate engaging element for contacting a peripheral portion of the upper tier plate at a location spaced from said lower portion of the upper tier plate for preventing movement away from the wall and parallel to the wall in one lateral direction;

a second upper pivotable holder secured to the upper support member having a third upper tier plate engaging element for contacting a peripheral portion of the upper tier plate at another location spaced from said lower portion of the upper tier plate for preventing movement of the upper tier plate away from the wall and parallel to the wall in the opposite lateral direction from said on lateral direction;

a lower support member having first and second lower tier plate engaging elements each for contacting a lower portion of one of the two lower tier plates for supporting and preventing movement away from the wall of the lower tier plates;

a first lower pivotable holder secured to the lower support member having a base support and a third plate engaging element for contacting a peripheral portion of one of the lower tier plates at a location spaced from said first lower tier plate engaging element for preventing movement of on of the two lower tier plates away from the wall and parallel to the wall in one lateral direction;

a second lower pivotable holder secured to the lower support member having a base support and a fourth plate engaging element for contacting a peripheral portion of the other of the lower tier plates at a location spaced from said second lower tier plate engaging element for preventing movement of one of the two lower tier plates away from the wall and parallel to to the wall in the opposite lateral direction from said one lateral direction;

a first lower rear support secured to the lower support member having a fifth plate engaging element for contacting a backside portion of one of the lower tier plated at a location spaced between said first and third lower tier plate engaging elements for preventing movement of said plate toward the wall; and a second lower rear support secured to the lower support member having a sixth plate engaging element for contacting a backside portion of the other of the lower tier plates at a location spaced between said second and fourth lower tier plate engaging elements for preventing movement of said other plate toward the wall.

3. A multi-tiered wall hanging plate holder apparatus of claim 2 further comprising a bracket interconnecting the upper support member and the lower support member, said upper and lower support members being secured to the bracket within a range of relative spacing to each other for accommodating a range of different sized plates on the lower tier.

4. The multi-tiered wall hanging plate holder apparatus of claim 3 wherein said bracket has at least one slot having a vertically extending component, and further comprising a fastener received in the at least one slot for securing the upper support member to the bracket.

5. The multi-tiered wall hanging plate holder of claim 3 wherein the upper and lower support members are secured to the bracket which is secured to the wall.

6. The multi-tiered wall hanging plate holder apparatus of claim 2 wherein upper support member further includes first and second lower tier plate engaging members for securing lower tier plates on the lower tier.

7. The multi-tiered wall hanging plate holder of claim 2 wherein said first and second lower rear supports are prongs formed of rigid material.

8. A multiple tier holder for a plurality of plates comprising:

an upper support having a first portion for engaging a first part of one of the plurality of plates to support such one plate against vertical movement and a second portion for engaging a second part of such one plate to support such one plate against horizontal movement, said second portion being pivotable with respect to said first portion; and a lower support having a first portion for engaging one part of another of the plurality of plates to support such other plate against vertical movement, a second portion for engaging a second part of such other plate to support such other plate against horizontal movement, said second portion being pivotable with respect to said first portion of said lower support, and a third portion for engaging a third part of such other plate to support such other plate against backward movement, said upper support being slidably shiftable with respect to said lower support to permit said upper support to engage a third part of such other plate to secure such other plate in the lower support.

9. The multiple tier holder of claim 11 wherein said upper support includes a third portion which is laterally spaced from said first portion of said upper support for engaging a third part of such one plate for supporting such one plate against vertical movement and a fourth portion laterally spaced from said second portion of said upper support for engaging a fourth part of said one plate for supporting said one plate against horizontal movement, said fourth portion of said upper support being pivotable with respect to said third portion thereof; and wherein said lower support includes a fourth portion laterally spaced from said first portion of said lower support for engaging a first part of a third one of said plurality of plates for supporting such third plate against vertical movement, a fifth portion laterally spaced from said second portion of said lower support for engaging a second part of said third plate for supporting such third plate against horizontal movement, and a sixth portion which is laterally spaced from said third portion and is adjacent to a decorative arm of said fifth portion of said lower support for engaging a third part of said third plate for supporting such third plate against backward movement, said fifth portion of said lower support being pivotable with respect to said fourth portion thereof.

10. A multiple tier holder of claim 8 wherein one of said upper support and lower support includes a fifth portion for engaging said second or third plate for supporting such plate against forward movement.

11. The multiple tier holder of claim 10 wherein said fifth portion is integral with the first portion of said one of said upper support and lower support.

12. A multiple tier plate holder comprising:

a first tier holder having first support means for supporting a first plate in one tier against vertical, horizontal, and backward movement, and a second tier holder having second support means for supporting a second plate in another tier against vertical and horizontal movement, said first tier holder and said second tier holder being adjustable with respect to each other for supporting said second plate against forward movement, at least one of said first and second tier holders includes pivotable means for supporting one of said first and second plates against forward movement.

13. A multiple tier plate holder comprising:

a first tier holder having first support means for supporting a first plate in one tier against vertical, horizontal, and backward movement, and a second tier holder having second support means for supporting a second plate in another tier against vertical and horizontal movement, said first tier holder and said second tier holder being adjustable with respect to each other for supporting said second plate against forward movement, at least one of said first and second support means includes a pivot.

14. A two tiered plate holder consisting of:

an upper support comprised of one pair of support members for preventing horizontal and vertical movement of a plate in an upper tier, wherein said support members include a member with an adjustable arm for allowing the upper tier to support plates of various sizes and a member for preventing forward movement of one or more lower tier plates;

a lower support comprised of two pairs of support members for preventing horizontal, vertical, and backward movement of said one or more lower tier plates in one direction, wherein said support members each include an adjustable arm for allowing the lower support to support said plate or plates of various sizes and a rear support for preventing backward movement of said plate or plates toward a wall; and the upper support and lower support are secured to a bracket which comprises elongated slots for slidable adjustment by either tier and is secured to the wall.

15. A multi-tiered wall hanging apparatus and a plurality of plates, the combination comprising:

one tier for support of one plate by means of at least two support members, each support member having a pivotable holder which prevents lateral movement, a lower stationary holder which prevents vertical movement, and another stationary holder which prevents forward movement of a second tier plate; and at least one other tier for support of at least one plate, having two sets of support members to prevent forward, lateral, and vertical movement of said plate or plates by means of one pivotable holder, one stationary holder connected to a backing bracket, one lower stationary holder, and one rear support prong which engage said plate or plates in at least four points about its outer periphery; and wherein one tier is slidably movable with respect to the other tier, said slidability of said tiers and said adjustability of said pivotable holder of said support members enabling the accommodation of a plurality of plates of different sizes.

* * * * *

UNITED STATES PATENT AND TRADEMARK OFFICE

CERTIFICATE OF CORRECTION

PATENT NO : 5,673,800

DATED : October 7, 1997

INVENTOR(S) : Robert Connolly

It is certified that error appears in the above-identified patent and that said Letters Patent is hereby corrected as shown below:

Column 6, Line 23, Claim 2, "on" should be --one--.

Signed and Sealed this

Twelfth Day of January, 1999

*Attest:*

*Attesting Officer*

*Acting Commissioner of Patents and Trademarks*